US010839720B1

(12) United States Patent
Sjöström

(10) Patent No.: US 10,839,720 B1
(45) Date of Patent: Nov. 17, 2020

(54) IT SERVER TAG, AND METHOD OF LABELING SERVER CHANNELS

(71) Applicant: T And B Innovations Inc., Knoxville, TN (US)

(72) Inventor: Tomas Sjöström, Powell, TN (US)

(73) Assignee: T And B Innovations Inc., Knoxville, TN (US)

( * ) Notice: Subject to any disclaimer, the term of this patent is extended or adjusted under 35 U.S.C. 154(b) by 0 days.

(21) Appl. No.: 16/514,526

(22) Filed: Jul. 17, 2019

Related U.S. Application Data

(63) Continuation-in-part of application No. 29/697,331, filed on Jul. 8, 2019.

(51) Int. Cl.

| | |
|---|---|
| ***G09F 3/02*** | (2006.01) |
| ***G09F 3/00*** | (2006.01) |
| ***G09F 3/10*** | (2006.01) |
| ***G09F 3/08*** | (2006.01) |

(52) U.S. Cl.
CPC ..... *G09F 3/0297* (2013.01); *G09F 3/08* (2013.01); *G09F 3/10* (2013.01); *G09F 2003/0222* (2013.01)

(58) Field of Classification Search
CPC ..... G09F 3/208; G09F 3/0297; G09F 3/08; G09F 3/10; G09F 2003/0222; E05D 5/02; E05D 5/0207; E05D 5/0215; E05D 5/0223; E05D 5/023; E05D 5/0238; E05D 5/04; E05D 5/043; E05D 5/046
See application file for complete search history.

(56) References Cited

U.S. PATENT DOCUMENTS

| | | | | |
|---|---|---|---|---|
| 5,421,113 | A * | 6/1995 | Gebka | A47F 5/0869 40/642.01 |
| 6,594,857 | B2 | 7/2003 | Nhep et al. | |
| 6,964,343 | B2 * | 11/2005 | Tilly | A47B 77/16 211/119.003 |
| 7,155,853 | B2 * | 1/2007 | Valiulis | A47F 5/0869 40/638 |
| 7,203,303 | B1 | 4/2007 | Beasley | |
| 7,585,191 | B2 | 9/2009 | Hawley et al. | |
| D745,605 | S | 12/2015 | Dancausse et al. | |
| 9,215,824 | B2 * | 12/2015 | Sun | H05K 7/00 |
| 9,430,004 | B2 | 8/2016 | Meadowcroft | |
| D768,780 | S | 10/2016 | Taddeo | |
| D788,745 | S | 6/2017 | Forster | |
| D814,569 | S | 4/2018 | McLean | |
| D839,963 | S | 2/2019 | Canchola et al. | |

(Continued)

OTHER PUBLICATIONS

Screen Shot of Black Box Rack Unit Labels; Accessed Jul. 2019; https://www.grainger.com/product/15E509?cm_sp=Product_Details-_-Products_Based_on_Your_Search-_-IDPPLARECS&cm_vc=IDPPLARECS; pp. 1.

(Continued)

*Primary Examiner* — Cassandra Davis
(74) *Attorney, Agent, or Firm* — Peter L. Brewer; Thrive IP

(57) ABSTRACT

An IT identification tag for a network server panel. The identification tag is designed to be releasably secured to existing equipment screws residing at the ends of standard server panels. The identification tag includes a pivoting label panel having a generally planar surface. The planar surface is adapted to receive identifying information such as a port number or a bar code. A method of labeling a server is also provided.

20 Claims, 12 Drawing Sheets

(56) References Cited

U.S. PATENT DOCUMENTS

| | | | | |
|---|---|---|---|---|
| D841,607 | S | 2/2019 | Sunagawa | |
| D842,817 | S | 3/2019 | Covell | |
| D843,328 | S | 3/2019 | Covell | |
| D845,250 | S | 4/2019 | Covell | |
| D854,090 | S | 7/2019 | Warther | |
| 10,595,434 | B2 * | 3/2020 | Chen | H05K 7/18 |
| 2009/0097212 | A1 | 4/2009 | Schmidt et al. | |
| 2009/0189767 | A1 * | 7/2009 | Primm | G01S 5/02 340/572.1 |
| 2010/0013600 | A1 | 1/2010 | Renfro, Jr. | |
| 2010/0065201 | A1 * | 3/2010 | Means | G09F 3/0288 156/277 |
| 2013/0071072 | A1 | 3/2013 | Xie | |
| 2013/0308912 | A1 | 11/2013 | Avlonitis et al. | |
| 2014/0126957 | A1 | 5/2014 | Shi et al. | |
| 2014/0153169 | A1 | 6/2014 | Kohonen et al. | |
| 2015/0288097 | A1 | 10/2015 | Yen | |

OTHER PUBLICATIONS

Screen Shot of StarTech.com Rack Unit Labels—Server Rack 52U Alignment Strips; Accessed Jul. 2019; https://www.cdw.com/product/startech.com-rack-unit-labels-server-rack-49u-alignment-strips-2-pack/4165202; pp. 4.

Multi-Level Rack Labels; Accessed Jul. 2019; https://www.expresscorp.com/Warehouse-Labels/Multi-Level-Rack-Labels; pp. 2.

Rack Cable Management; Accessed Jul. 2019; https://www.cableorganizer.com/computer-cabinets/cable-management-accessories.html; pp. 2.

Cable Management; Accessed Jul. 2019; https://www.rackmountsolutions.net/cable-management/; pp. 2.

Cable Management; Accessed Jul. 2019; https://www.racksolutions.com/rack-accessories/cable-management; pp. 3.

Racks & Cable Management; Accessed Jul. 2019; https://www.siemon.com/en/home/systems/racks-and-cable-management; pp. 2.

Cable and Wire Labeling; Accessed Jul. 2019; https://wiringnetworks.com/network-cabling-labeling/; pp. 2.

* cited by examiner

IT SERVER TAG, AND METHOD OF LABELING SERVER CHANNELS

STATEMENT OF RELATED APPLICATIONS

This application is filed as a Continuation-In-Part of U.S. Ser. No. 29/697,331. That application was filed on Jul. 8, 2019 and is entitled "IT Server Tag."

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of information technology. More specifically, the present invention relates to a tag and a method of using a tag to mark or label network server channels, or ports.

Discussion of Technology

FIG. 1 is a perspective view of a known network server 100. The network server 100 represents a computer, or more specifically a stack of computers, that routes information to other devices. The "other devices" represent remote individual computers, printers, and even other servers, referred to in the industry as clients. The network server 100 communicates with these other devices through a local area network (LAN). In some instances, the network server 100 also communicates with external servers such as a cloud or the Internet, through a wide area network (WAN).

In FIG. 1, the network server 100 resides on and is supported by a cabinet 110. The cabinet 110 is sometimes referred to as a server rack. The cabinet 110 includes a base 102, side walls 104 and then a series of adjustable shelves (not visible). The shelves support individual servers 120 and other components that make up the network server 100.

There are different types of individual servers 120 that may be placed on a network server 100. These include, for example, Web servers, mail servers, file servers and print servers. The standard server in an office environment is the file server 120*a*. A file server 120*a* is basically a computer that stores files that can be accessed by other computers. Two file servers 120*a* are shown stacked on shelving in FIG. 1. Other illustrative servers shown in FIG. 1 include a Web server 120*b*, mail servers 120*c* and a printer server 120*d*. The Web server 120*b* may include a domain controller while one of the file servers 120*a* may be a storage server.

Each individual server 120 is essentially its own computer having a motherboard, a central processing unit, random access memory, a hard drive and a power supply (referred to sometimes as an uninterruptible power supply, or UPS). Two UPS modules are shown at 140. Of interest, network servers typically do not require a lot of processing power, but they do need considerable RAM and a fast hard drive.

In FIG. 1, the network server 100 also includes a graphics processing unit, or GPU 130. Here, the GPU 130 is made up of a keyboard 132 and a monitor 134. The network server 100 also includes an optional firewall/VPN/Cache unit 160. Management software is loaded onto the storage server and accessed via the GPU 130.

The network servers 120 are used within a local network of devices and typically require a password or some kind of authentication to connect to it. The password is entered using the GPU 130, or optionally accessed remotely through a wireless communications network. Those of ordinary skill in the art will understand that some network servers are comprised of numerous file servers 120 occupying a number of cabinets 110.

The servers 120 are connected to the network of computers and other devices (or LAN) by means of data cables. In the interest of clarity, cables are not shown in FIG. 1; however, FIG. 2 is an enlarged view of panels 125 of illustrative servers, such as any of servers 120 of FIG. 1. In this view, a large number of cables 240 is shown, with some of the cables 240 being connected to the panels 125.

The panels 125 include a series of ports 127, wherein each of the ports 127 is configured to receive a respective cable 240. In computer networking, a port 127 is an endpoint of communication. Each cable 240 is routed from a port 127 to a corresponding data port for a remote computer or printer (not shown). Beneficially, each port 127 offers a data transfer speed, typically starting at 10 Gbps.

In operation, the various ports 127 are identified by a port number. A port number is a 16-bit integer, ranging from 0 to 65535. The most common protocols that use port numbers are the Transmission Control Protocol (or TCP) and the User Datagram Protocol (or UDP). For TCP, port number 0 is reserved and cannot be used, while for UDP, the source port is optional and a value of zero means no port.

It is frequently desirable for the network administrator to know which cables 240 are associated with each computer or printer or other device. It is even more desirable for the network administrator to know the port numbers associated with the various ports 127. However, as can be readily seen from the panels 125 of FIG. 2, there is no way for an IT worker to know, merely by looking at the panel 125, which remote computer or printer the ports 127 and cables 240 are associated with, or what the port numbers are.

Therefore, a need exists for a labeling system for a network server panel. A need further exists for an IT server tag useful for labeling server channels (or ports) along a network server panel. Still further, a need exists for a method of labeling ports along a network server panel.

SUMMARY OF THE INVENTION

An IT identification tag for a network server panel is first provided herein. The identification tag is designed to be releasably secured to existing equipment screws residing at an end of a standard server panel.

In one aspect, the identification tag first comprises a base. The base has at least one slot for receiving a respective equipment screw. Preferably, the at least one slot comprises a pair of slots. The equipment screws are connected to the network server panel itself, with the pair of slots being spaced apart to receive the existing equipment screws.

The identification tag also includes a support panel. The support panel extends up from the base. Preferably, the support panel extends up in transverse relation to the base.

The identification tag further includes a label panel. The label panel is pivotally connected to the support panel at an upper end of the support panel. The label panel defines a generally planar surface adapted to receive identifying information.

In one aspect, the identifying information comprises handwritten text. In another aspect, the server tag additionally comprises an adhesive sticker that is dimensioned to be placed on the planar surface of the label panel. In this instance, the adhesive sticker is configured to receive the identifying information, which may include written or printed text.

In a preferred embodiment, the label panel is removable from the support panel. To this end, a pivoting connection is provided between the label panel and the support panel. The pivoting connection may comprise:

a frusto-circular member connected to the label panel; and a rod extending along an upper edge of the support panel;

wherein the frusto-circular member is configured to releasably snap onto the rod.

A method of labeling a server is also provided herein. The server comprises a panel having one or more equipment screws. In one embodiment, the method comprises providing an IT server tag. The IT server tag may be in accordance with the identification tag described above (and described elsewhere herein) in its various embodiments.

The method then includes placing the base along the panel of the server. The method further includes securing the base to the panel of the server by tightening an equipment screw along each of the at least one slot and into the panel.

In one aspect, the method also comprises writing the identifying information onto the planar surface by hand. Alternatively, the method comprises adhering printed information as the identifying information onto the planer surface.

In another aspect, the method comprises writing or printing identifying information onto an adhesive sticker, and then securing the adhesive sticker onto the planar surface of the label panel. The identifying information may be, for example, a bar code.

As noted above, the label panel is preferably detachable from the support panel. In this instance, the method may further include removing the label panel from the support panel. This is primarily done for convenience before writing on the label panel or otherwise applying identification information onto the label panel.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

For purposes of the present application, it will be understood that the term "tag" refers to an article that may be attached to a server panel for purposes of labeling a network channel, or port.

The term "IT" is an acronym for "information technology."

As used herein, the term "network server" refers to a physical item of hardware having channels by which network data cables may be placed in mechanical and electrical communication with remote devices.

DESCRIPTION OF SPECIFIC EMBODIMENTS

Figure 3:
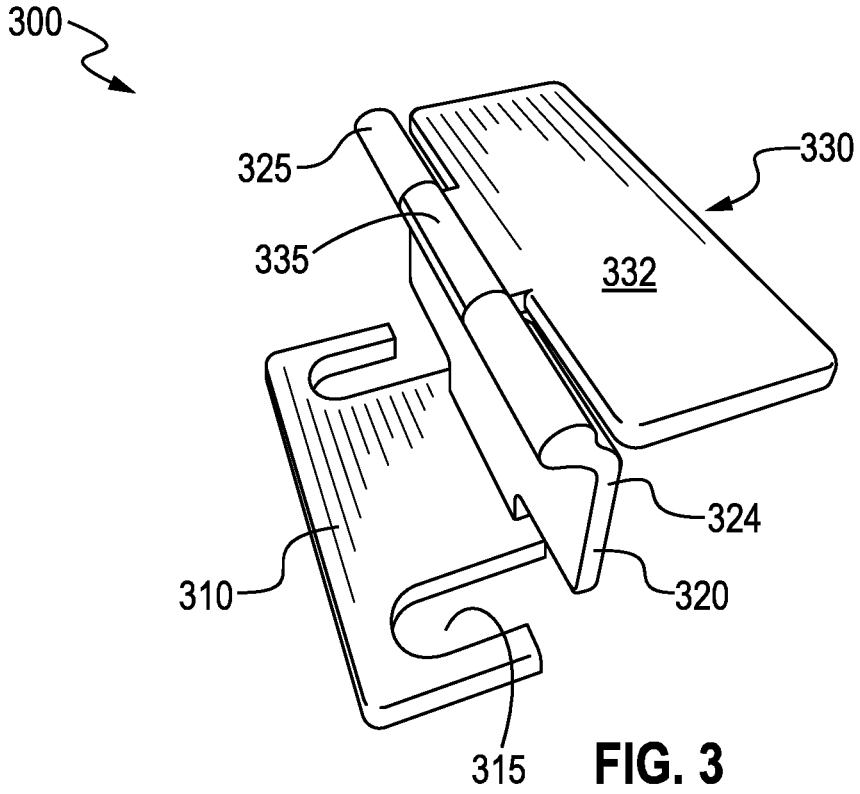
FIG. 3 is a first perspective view of an IT server tag of the present invention, in one embodiment. In this view, a pivoting label panel is shown, with the label panel being pivoted into a horizontal orientation.
Figure 4:
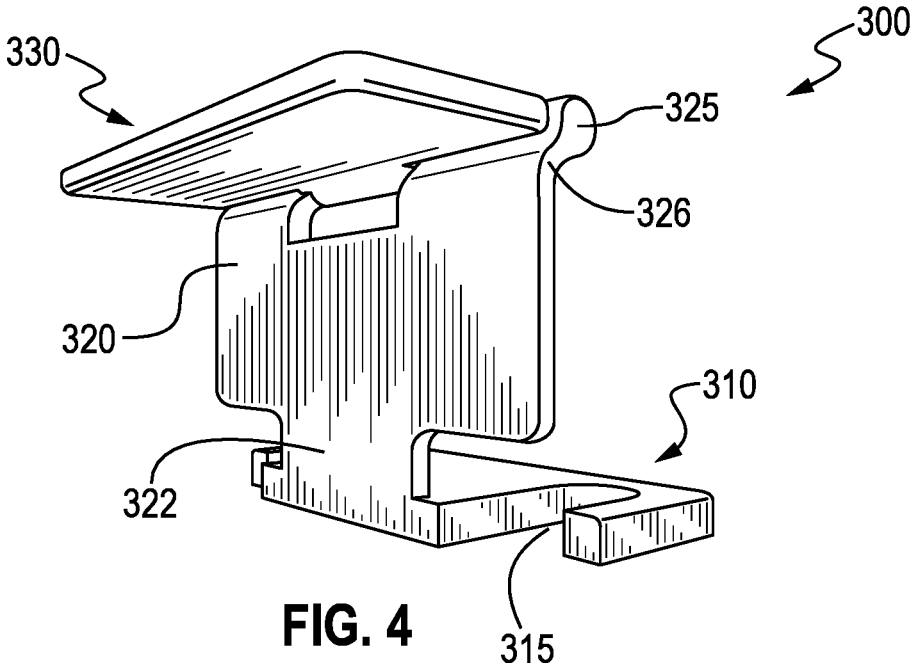
FIG. 4 is a second perspective view of the IT server tag of FIG. 3, shown from an opposite side.

FIG. 3 is a first perspective view of an IT server tag 300 of the present invention, in one embodiment. The view is taken from an upper, front view. FIG. 4 is a second perspective view of the IT server tag 300. Here, the view is generally taken from a rear view. The server tag 300 will be introduced with reference to FIGS. 3 and 4 together.

The IT server tag 300 first includes a base 310. The base 310 comprises a generally planar platform, with a pair of opposing slots 315 formed therein. The slots 315 are configured to slidably receive equipment screws from a server panel.

The IT server tag 300 also includes a support panel 320. The support panel 320 includes a first end 322 and a second opposite end 324. The first end 322 is connected to the base 310, while the second end 324 extends up and away from the base 310 in generally transverse relation.

It is preferred that the relative position of the support panel 320 to the base 310 is a rigid 90°. However, in one aspect a pivoting connection (not shown) is provided between the first end 322 of the support panel 320 and the base 310. The pivoting connection allows the support panel 320 to pivot across an angle that is 10° up to 30° from transverse.

The IT server tag 300 further includes a label panel 330. The label panel 330 defines a generally planar surface 332. The planar surface 332 is designed to receive identifying information for a server or server channel. Such identifying information may include handwritten text placed directly onto the planar surface 332. More preferably, the identifying information represents text or bar code information placed onto an adhesive sticker (shown at 360 in FIG. 10C) that is then applied to the planar surface 322.

It is observed that the label panel 330 may have two opposing planar surfaces 332. In this instance, the IT administrator or worker may optionally label either or both planar surfaces 332.

Beneficially, the label panel 330 is pivotally connected to the support panel 320. The pivotal connection comprises a frusto-circular piece 335 residing along one side of the label panel 330. The pivotal connection also includes a rod (not visible in FIG. 3 or 4, but shown at 323 in FIGS. 10A and 10B) that receives the frusto-circular piece 335 by means of a snap-fit. The rod 323 has a circular profile, and is bounded by opposing circular shoulder members 325. The shoulder members 325 hold the frusto-circular piece 335 in place laterally.

Preferably, the distal end 324 of the support panel 320 includes an angled tip 326. The angled tip 326 allows the pivoting label panel 330 to rotate into a position immediately adjacent to the vertical support panel 320. This relation is shown and discussed further below in connection with FIGS. 12A and 12B.

In both FIGS. 3 and 4, the label panel 330 is pivoted into a horizontal position. However, the angled tip 326 allows the label panel 330 to pivot across a range of about 300°. Beneficially, the label panel 330 may be removed from the support panel 320, such as for ease of applying written or printed text to the planar surface 332. The label panel 330 may then be snapped back into place by friction-forcing the frusto-circular member 335 back onto the rod 323.

Figure 1:
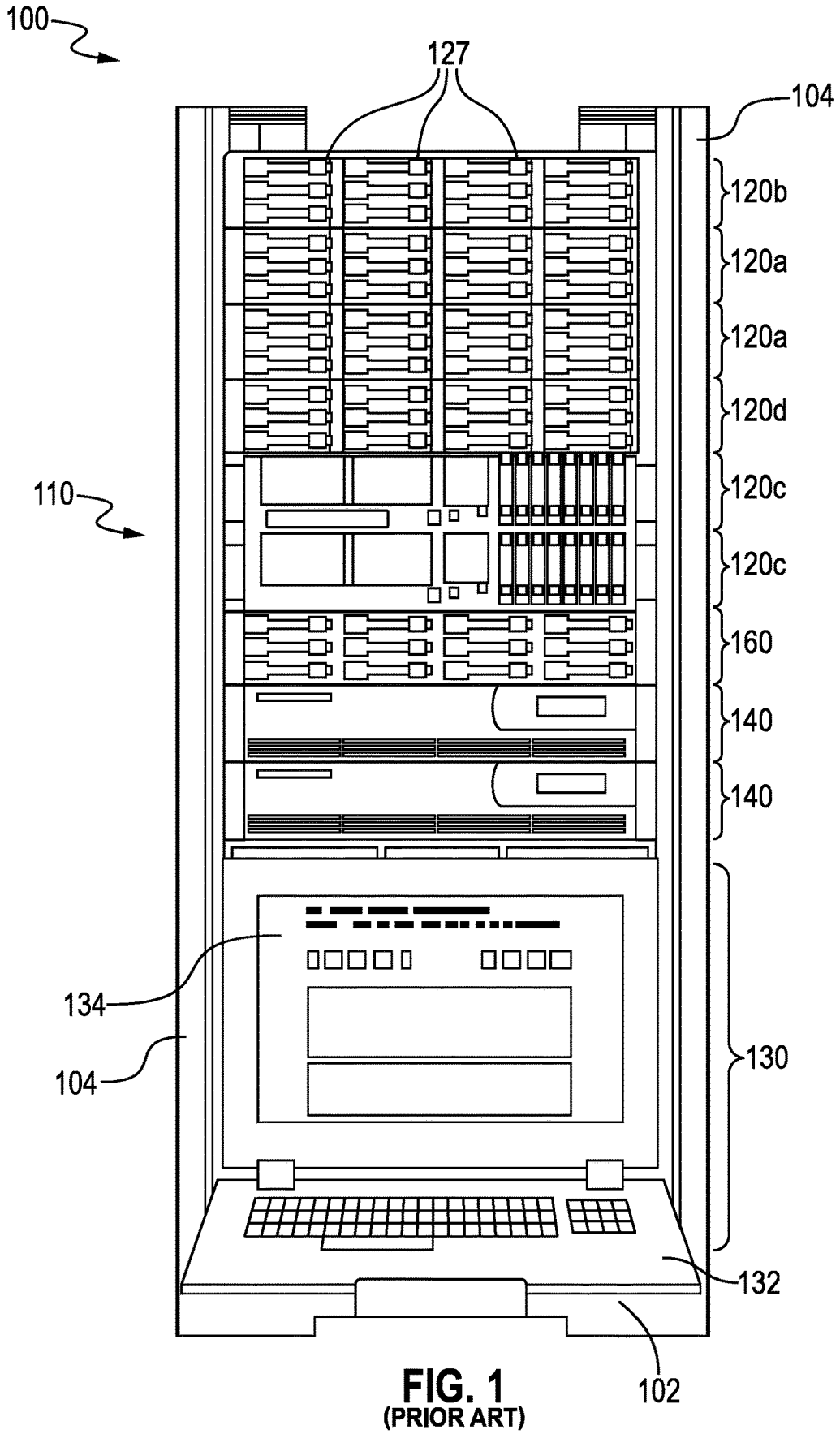
FIG. 1 (PRIOR ART)
FIG. 1 is a perspective view of a known network server. A series of individual servers is shown placed along a server cabinet making up the network server.
Figure 2:
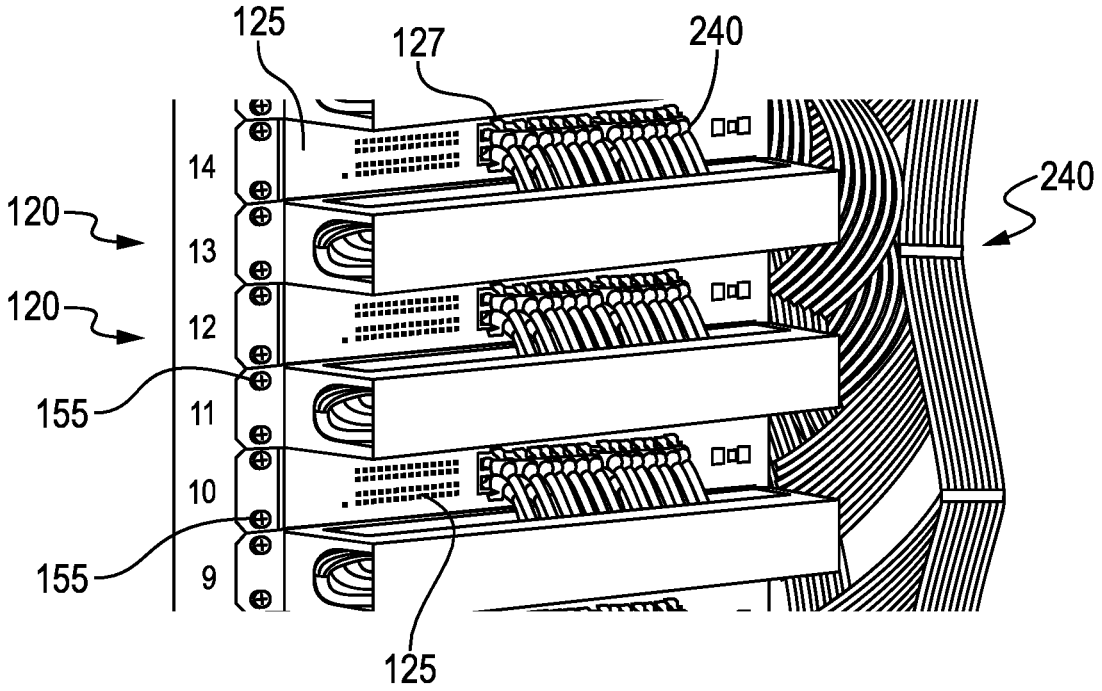
FIG. 2 (PRIOR ART)
FIG. 2 is an enlarged view of a portion of an illustrative network server. Several individual panels are seen along with a plurality of data cables.
Figure 5A:
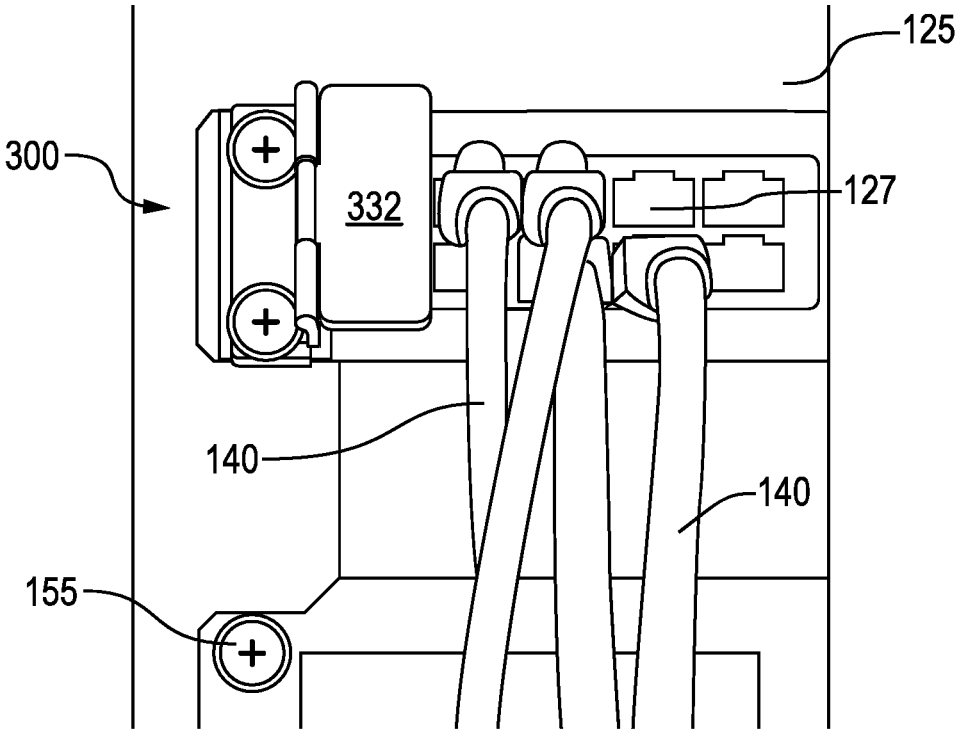
FIG. 5A is an enlarged view of a portion of the network server from FIG. 2. In this view, the IT server tag of FIGS. 3 and 4 has been attached to end screws of a server panel. The label panel of the server tag has been pivoted clockwise.

FIG. 5A is another view of the portion of the network server from FIG. 2. Specifically, a portion of a server panel 125 is shown enlarged. In this view, the IT server tag 300 of FIGS. 3 and 4 has been attached to end screws (shown at 155 in FIG. 2). In this view, the label panel 320 has been rotated to the right, that is, clockwise. No text or other identifying information has been applied to the planar surface 322 of the label panel 320.

Figure 5B:
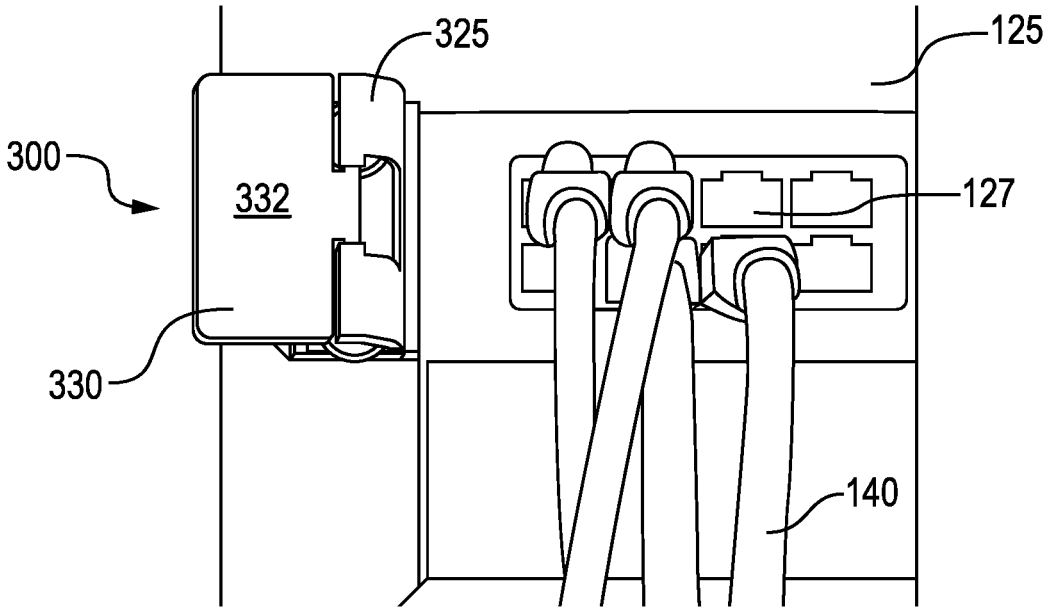
FIG. 5B is another enlarged view of the server panel of FIG. 5A. In this view, the IT server tag is again secured to the server panel. Here, the label panel has been pivoted counter-clockwise.

FIG. 5B is another enlarged view of the server panel 125 of FIG. 5A. In this view, the IT server tag 300 is again secured to the server panel 125. Here, the label panel 320 has been rotated to the left, that is, counter-clockwise.

Figure 6:
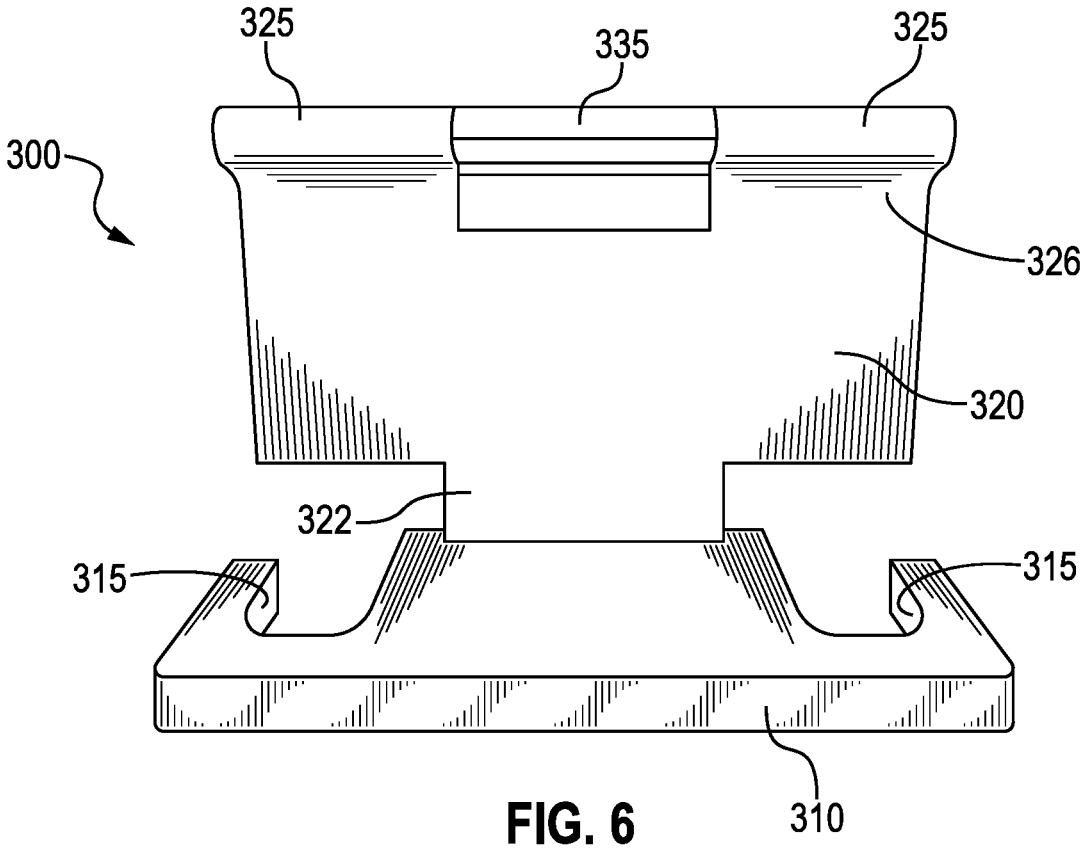
FIG. 6 is a front perspective view of the IT server tag of FIGS. 3 and 4.
Figure 7:
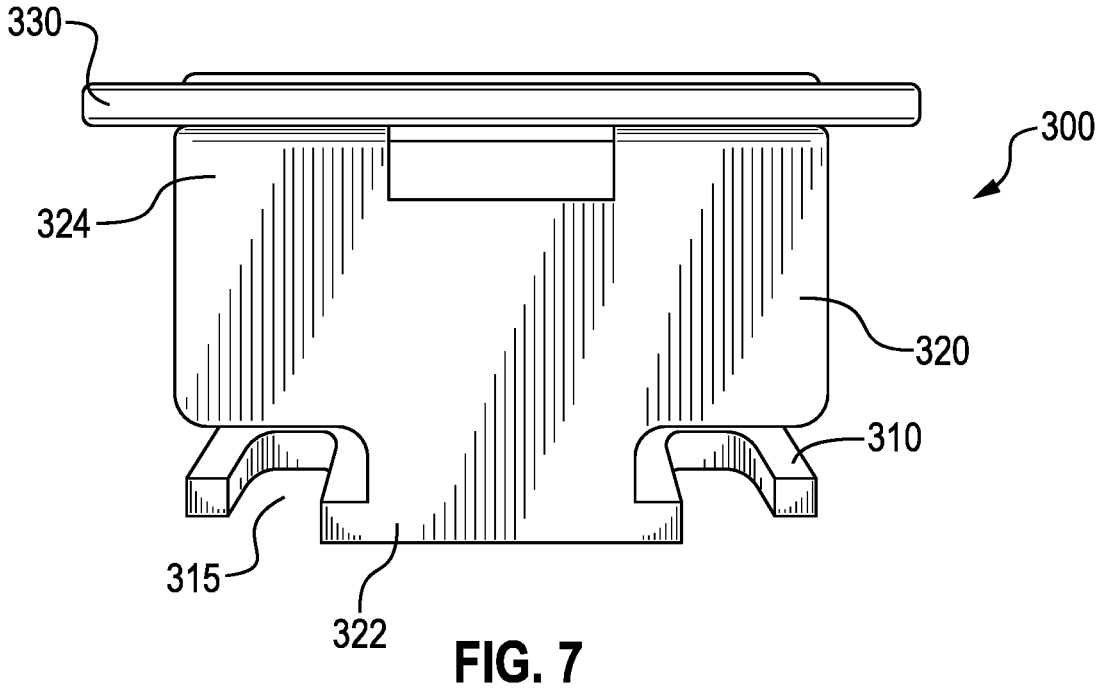
FIG. 7 is a rear perspective view of the IT server tag of FIGS. 3 and 4.
Figure 8:
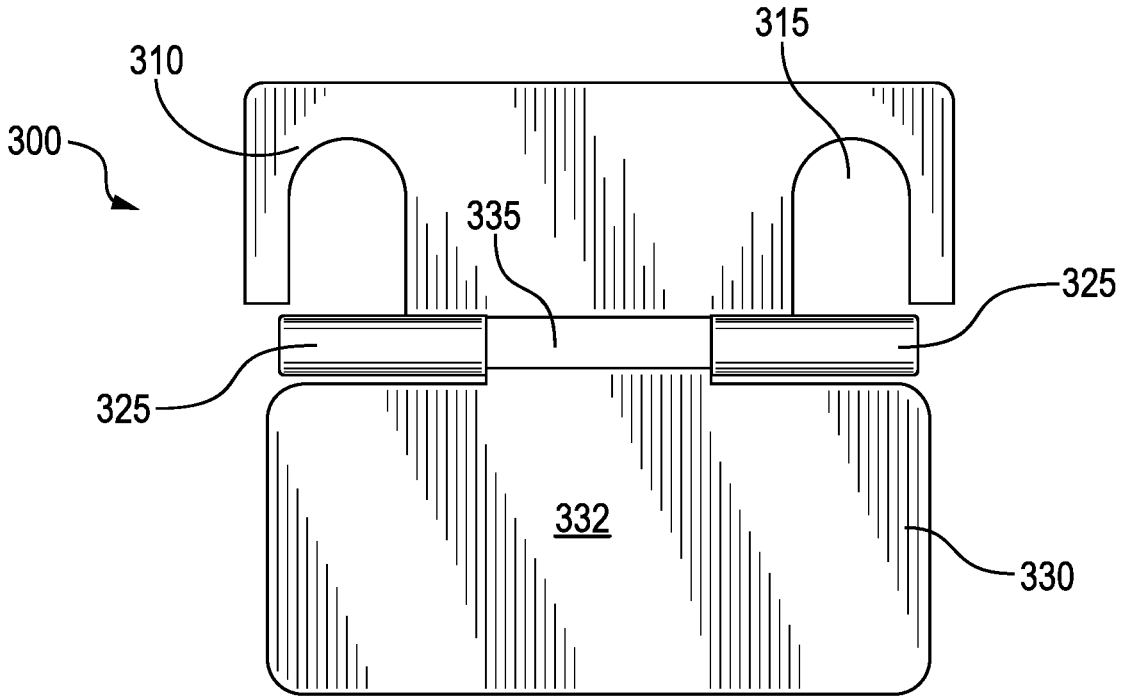
FIG. 8 is a top plan view of the IT server tag of FIGS. 3 and 4.
Figure 9:
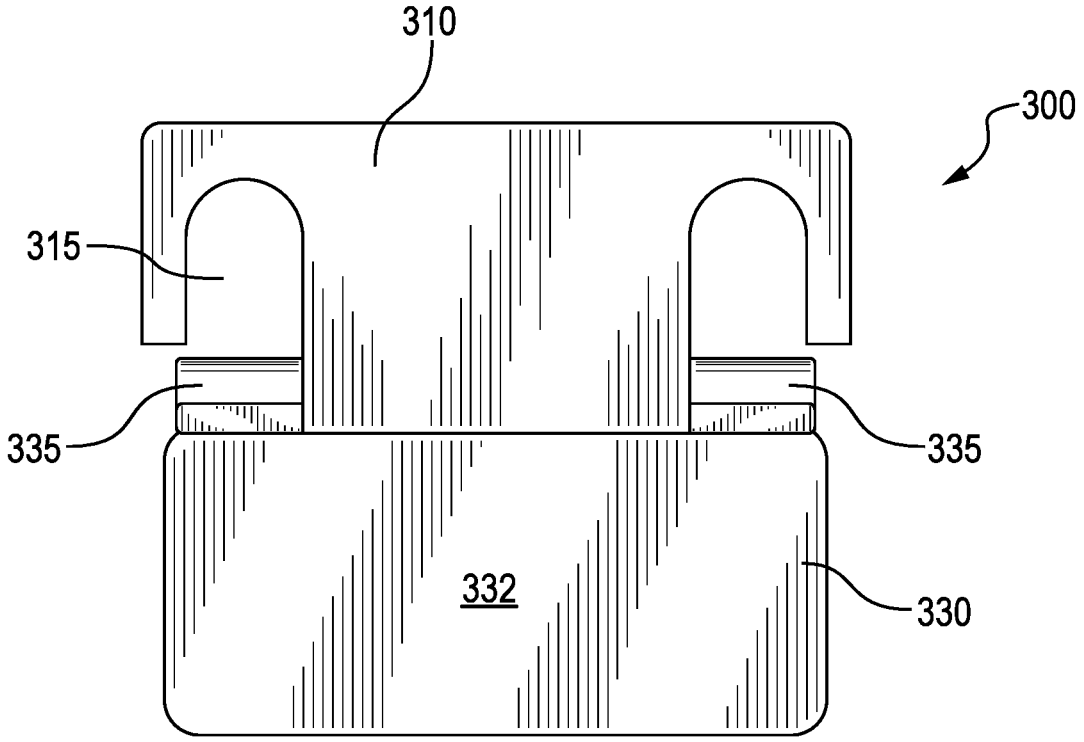
FIG. 9 is a bottom view of the IT server tag of FIGS. 3 and 4.

FIGS. 6-9 provide additional views of the IT server tag 300 of FIGS. 3 and 4. FIG. 6 is a front perspective view of the IT server tag 300, while FIG. 7 is a rear perspective view. FIG. 8 is a top plan view of the IT server tag 300 of FIGS. 3 and 4, while FIG. 9 is a bottom view.

Figure 10A:
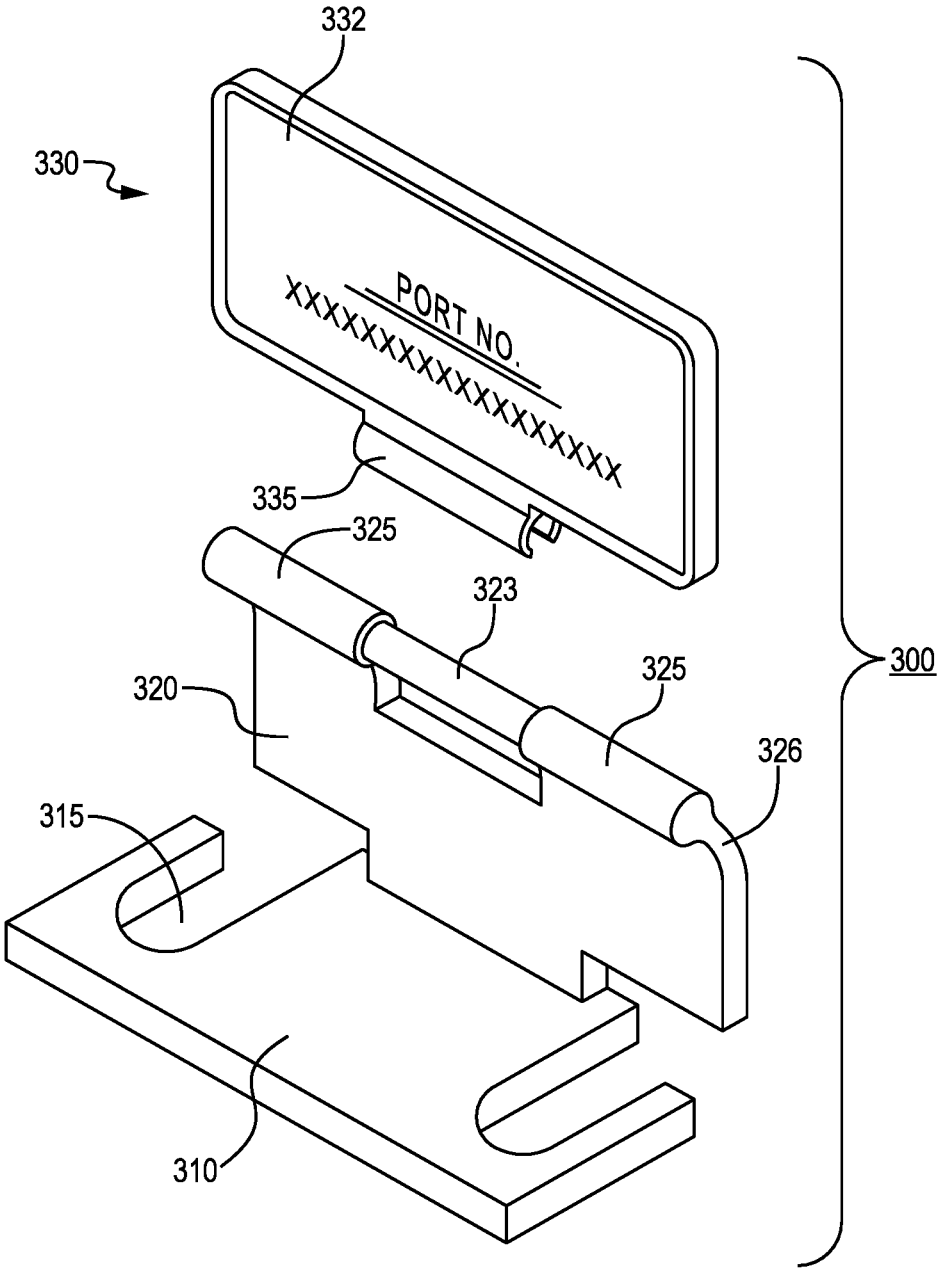
FIG. 10A is a third perspective view of the IT server tag of FIGS. 3 and 4. In this view, the pivoting label panel is shown in exploded-apart relation to the support panel.

FIG. 10A is a third perspective view of the IT server tag 300 of FIGS. 3 and 4. In this view, the pivoting label panel 330 is exploded away from the support panel 320. The label panel 330 has been rotated about 90° into a position that is parallel with the support panel 320.

Figure 10B:
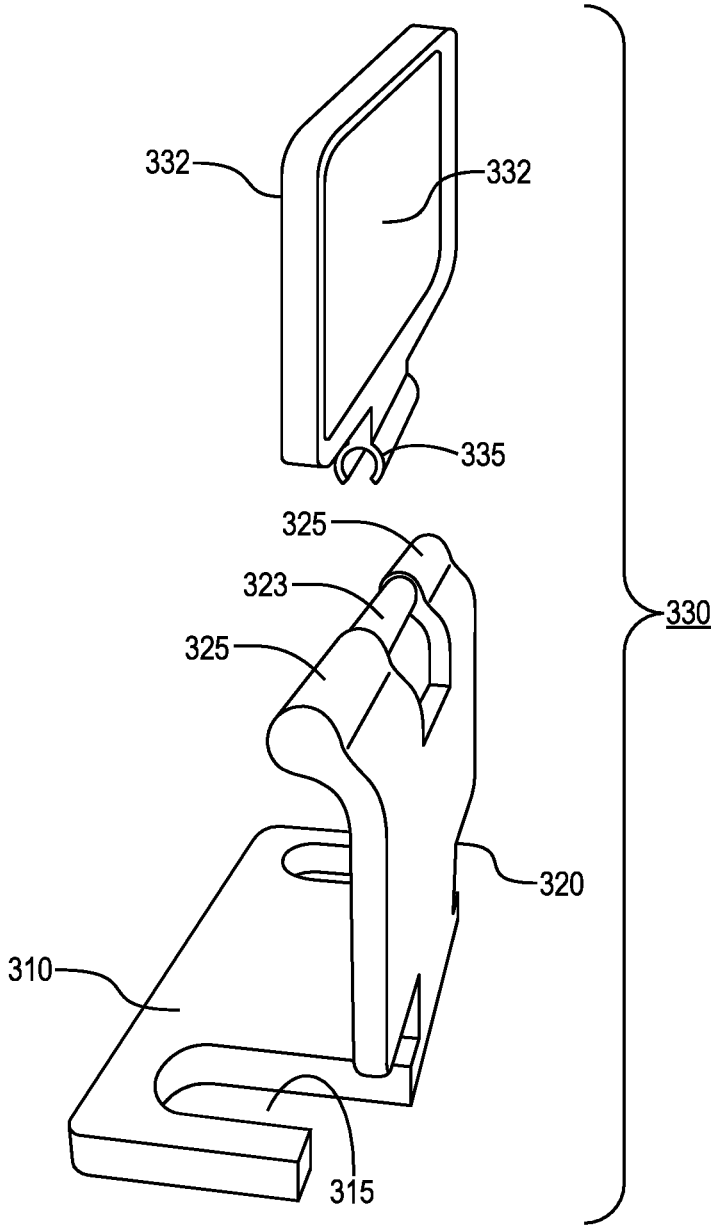
FIG. 10B is a fourth perspective view of the IT server tag of FIGS. 3 and 4. In this view, the pivoting label panel is again shown in exploded-apart relation to the support base, but is shown from a different perspective.

FIG. 10B is a fourth perspective view of the IT server tag 300 of FIGS. 3 and 4. In this view, the pivoting label panel 330 is again shown in exploded-apart relation to the support panel 320.

Figure 10C:
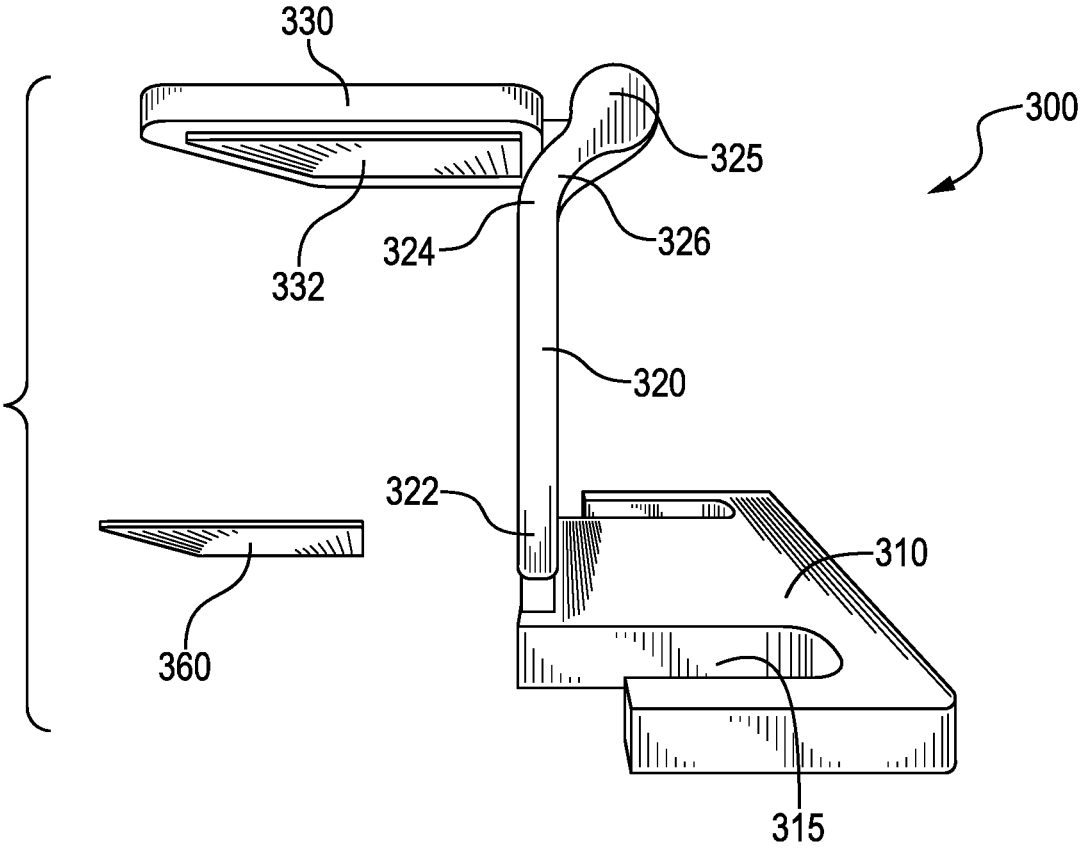
FIG. 10C is a side perspective view of the IT server tag of FIGS. 3 and 4. Here, the server tag includes an adhesive sticker, which is shown in exploded-apart relation to the label panel.

FIG. 10C is a side perspective view of the IT server tag 300 of FIG. 10. In this view, an adhesive sticker 360 is shown. The sticker 360 is shown in exploded-apart relation to the planar surface 332 of the label panel 330. Preferably, the adhesive sticker 360 comprises a removable film along one side, allowing the user to peel off the film and expose an adhesive substance. An opposing side of the adhesive sticker 360 is preferably a cellulosic material suitable for receiving handwritten or laser-jet printed material as identifying information.

Figure 11:
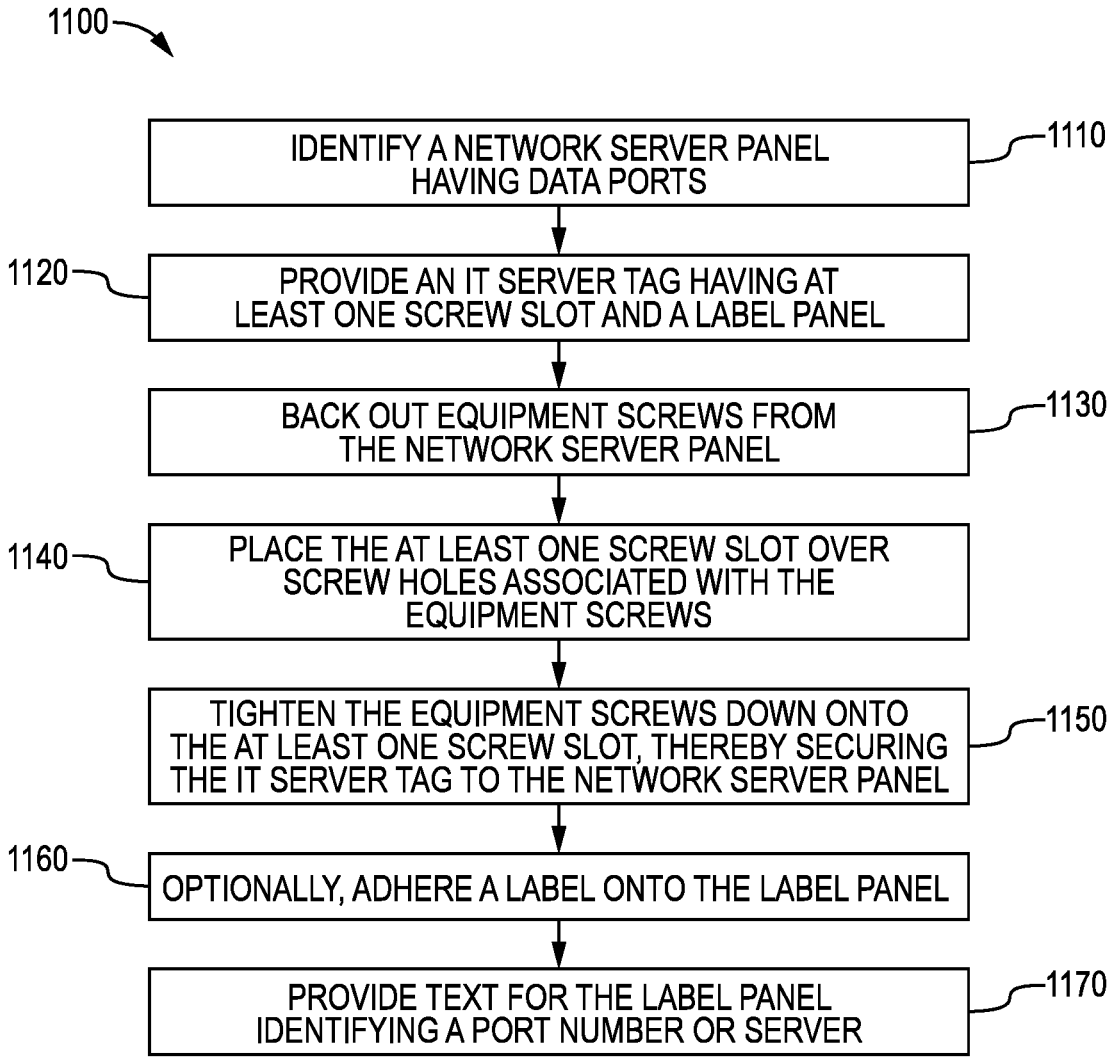
FIG. 11 is a flow chart showing steps for a method of labeling a server panel, in one embodiment.

FIG. 11 is a flow chart showing steps for a method 1100 of labeling a server panel, in one embodiment. The method 1100 employs the IT server tag 300.

The method 1100 first includes identifying a network server panel having data ports. This is shown in Box 1110. The network server panel is associated with an individual network server, such as network server 100, and includes at least one, and preferably a pair, of equipment screws 155. These equipment screws 155 are located at the end of a server panel 125 as part of a standard arrangement.

The method 1100 also includes providing an IT server tag. This is provided in Box 1120. The IT server tag is in accordance with the identification tag 300 described above, in its various embodiments. Specifically, the IT server tag will include at least one screw slot 315 and a label panel 320. Preferably, a pair of screw slots 315 are provided, which are spaced apart in accordance with the equipment screws 155 already in place.

In one aspect, each screw slot 315 is simply a through-opening dimensioned to receive a screw 155. More preferably, each screw slot 315 has an open end, allowing the slot 315 to receive a screw 155 without completely backing out the screw 155 from the panel 125.

The method 1100 further includes backing out the equipment screws 155 from the network server panel 125. This is indicated in Box 1130. This would typically be done by using a short-length screwdriver.

The method 1100 next includes placing at least one screw slot 315 over screw holes associated with the equipment screws 155. This is provided at Box 1140. In connection with this step, preferably the screws 155 remain at least partially in their respective screw holes. This means that the screws 155 are only partially backed out, allowing the slots 315 to slidably receive the screws 155 under respective screw heads.

Figure 12A:
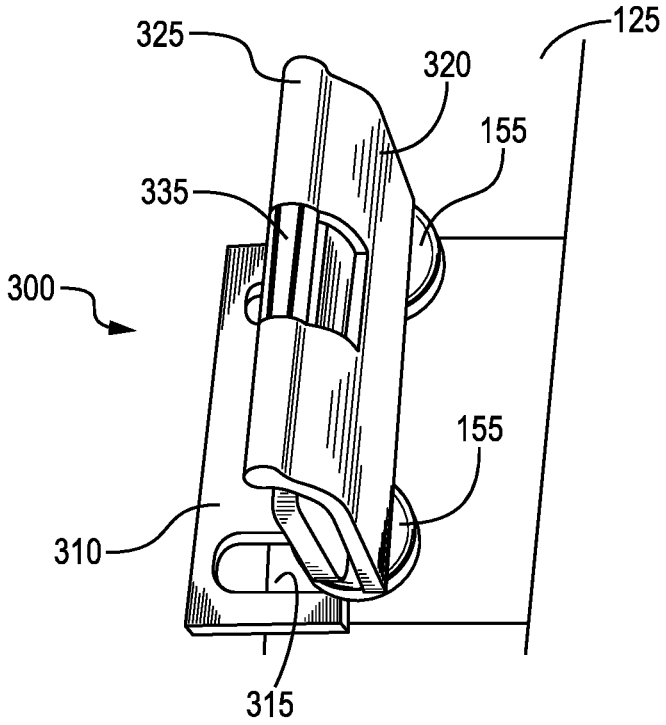
FIG. 12A is an enlarged view of the server panel of FIGS. 3 and 4. In this view, the IT server tag is being slipped under two equipment screws. Here, the label panel for the IT server tag is folded over for ease of installation.

The step of Box 1140 is illustrated in FIG. 12A. FIG. 12A is an enlarged view of the server panel 125 of FIG. 5. In this view, the IT server tag 300 is being slipped under two equipment screws 155. Here, the label panel 320 for the IT server tag 300 is folded over for ease of installation.

The method 1100 next includes tightening the equipment screws 155 down onto the screw slots 315. This is seen at Box 1150. This step serves to secure the IT server tag 300 to the network server panel 125.

Figure 12B:
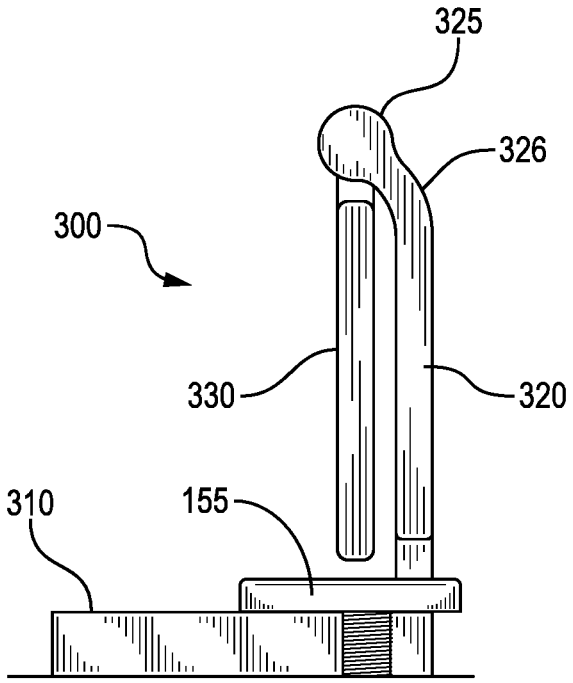
FIG. 12B is a side view of the server panel of FIG. 12A.

FIG. 12B is a side view of the IT server tag 300 of FIG. 12A. Here, the slots 315 have received the screws 155. The screws 155 are tightened down onto the respective slots 315, securing the server tag 300 in place on a server panel 125.

As an optional step for the method 1100, an IT worker may adhere a label (such as adhesive sticker 360) onto the label panel 320. This is shown at Box 1160. The label will have identifying information concerning the cables or the ports associated with a server 120.

The method 1100 will also include providing text for the label panel 330, or more specifically for one of the planar surfaces 332 on the label panel 330. This is indicated at Box 1170. Text may include typewritten text, handwritten text, or a bar code. Preferably, though not exclusively, the text is indicative of a port number or device description.

The present inventions also include the presentation of an IT server tag assembly. The server tag assembly represents a packaging holding a plurality of adhesive stickers and a plurality of server tags. The packaging is designed to present the assembly for commercial sale. For example, the packaging may be a transparent plastic bag or a lightweight cardboard box.

Figure 13:
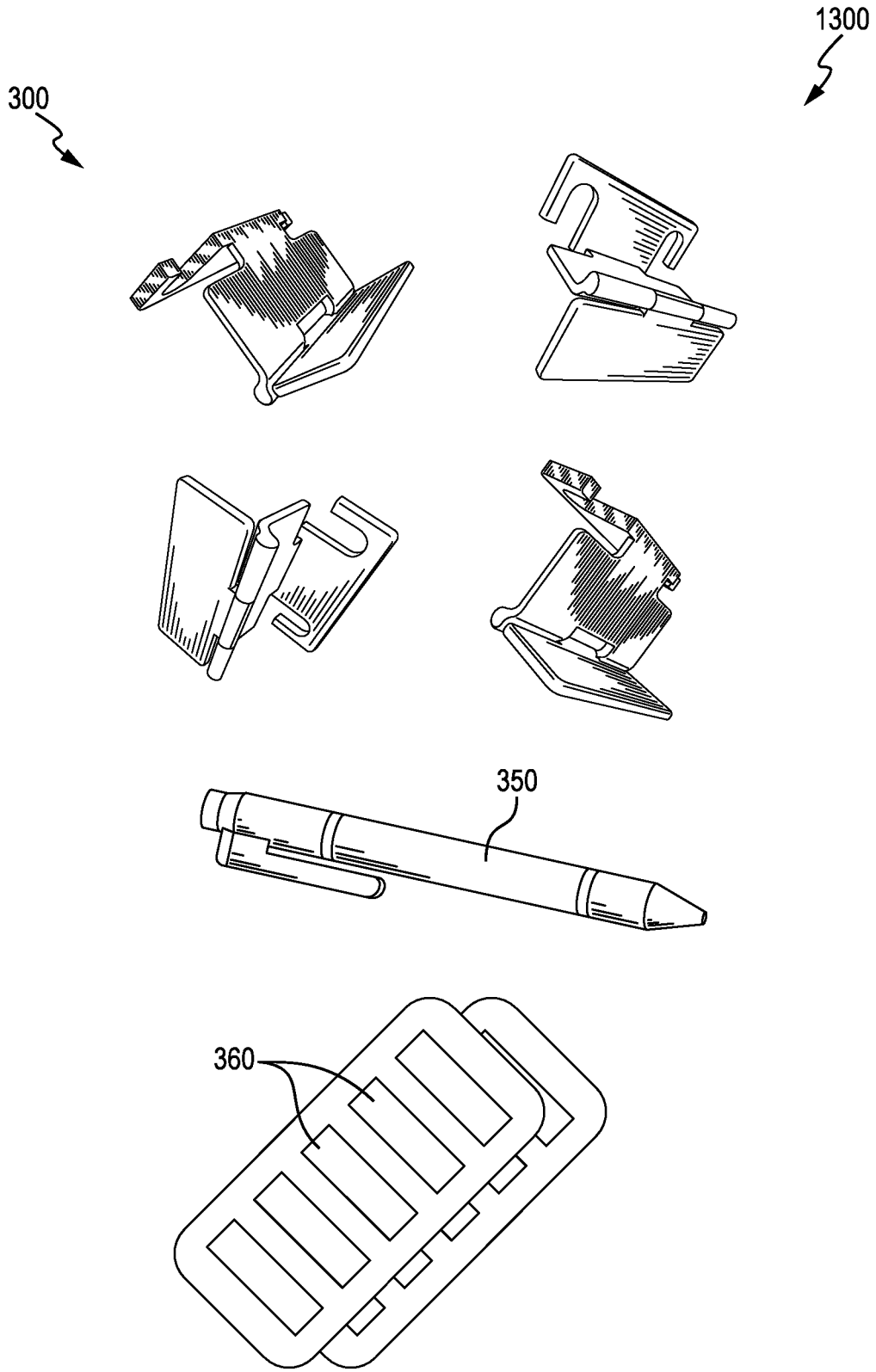
FIG. 13 is a perspective view of a plurality of IT server tags. Also shown are a plurality of labels, configured to be affixed onto the label panels of the respective IT server tags.

FIG. 13 is a perspective view of a plurality of IT server tags 300. Also shown are a plurality of labels 360. The labels 360 are configured to be affixed onto the label panels of the respective IT server tags. Preferably, the labels 360 represent adhesive stickers. Also shown in FIG. 13 is an illustrative marker 350. Together, the server tags 300, the marker 350, and the adhesive stickers 360 comprise an IT server tag assembly 1300.

Each of the adhesive stickers comprises a cellulosic layer, wherein the cellulosic layer is designed to receive printed information. In one aspect, the plurality of adhesive stickers represents sheets of adhesive stickers, with each sticker having a peelable film for exposing an adhesive material used for securing the sticker to a planar surface of a label panel.

Each of the server tags is designed in accordance with the server tag 300 as described herein, in any of its various embodiments. Generally, each server tag will comprise:

a base having a pair of slots for receiving respective equipment screws, wherein the equipment screws are connected to a network server panel;

a support panel extending up from the base; and a label panel pivotally connected to the support panel, wherein the label panel defines a generally planar surface adapted to receive the adhesive sticker.

Preferably, each of the IT server tags further comprises:

a pivoting connection between the label panel and the support panel;

and wherein the support panel comprises:

a first end connected to the base; and a second end opposite the first end, with the second end forming an angled tip;

and wherein the angled tip terminates in the pivoting connection.

Optionally, the IT server tag assembly further includes one or more labeling pens.

Further variations of the IT server tag and of the method for labeling a server channel may fall within the spirit of the claims, below. It will be appreciated that the inventions are susceptible to modification, variation and change without departing from the spirit thereof

I claim:

1. A server tag for a network server panel, comprising:

a base having at least one slot for receiving an equipment screw, wherein:

the equipment screw is connected to the server panel; and each of the at least one slots comprises an open end configured to slidably receive a shaft of a respective screw when the screw is backed out of the server panel;

a support panel extending up from the base in a generally transverse relation, wherein the support panel comprises:

a first end connected to the base;

a second end opposite the first end, with the second end forming an angled tip; and a label panel connected to the support panel through a pivoting connection, wherein the label panel defines a generally planar surface adapted to receive identifying information;

and wherein the angled tip terminates in the pivoting connection, permitting the label panel to move across a pivot angle that is at least 270°.

2. The server tag of claim 1, wherein:

the at least one slot comprises a pair of slots.

3. The server tag of claim 2, wherein:

the equipment screws are existing equipment screws associated with the server panel.

4. The server tag of claim 2, wherein the pivoting connection comprises:

a frusto-circular member connected to the label panel;

a rod extending along an upper edge of the support panel;

and wherein the frusto-conical member is configured to releasably snap onto the rod.

5. The server tag of claim 1, wherein the identifying information comprises handwritten text.

6. The server tag of claim 1, further comprising:

an adhesive sticker dimensioned to be placed on the planar surface of the label panel;

and wherein the adhesive sticker comprises a surface designed to receive the identifying information.

7. The server tag of claim 1, wherein the label panel is removable from the support panel.

8. The server tag of claim 7, further comprising:

a pair of shoulders residing along the rod dimensioned to hold the frusto-circular member laterally in place along the rod when the label panel is snapped onto the rod.

9. The server tag of claim 7, wherein the support panel extends up from the base in a fixed, transverse relation to the base.

10. The server tag of claim 6, wherein the identifying information comprises a bar code.

11. A method of labeling a server, the server comprising a panel having one or more equipment screws, and the method comprising:

providing an IT server tag, the IT server tag comprising:

a base having at least one slot;

a support panel extending up from the base in a generally transverse relation, wherein the support panel comprises:

a first end connected to the base;

a second end opposite the first end, with the second end forming an angled tip; and a label panel pivotally connected to the support panel, wherein the label panel defines a generally planar surface adapted to receive identifying information, and wherein the angled tip terminates in the pivoting connection;

placing the base along the panel of the server; and securing the base to the panel of the server by tightening an equipment screw along each of the at least one slot and into the panel.

12. The method of claim 11, wherein:

the at least one slot comprises a pair of slots.

13. The method of claim 11, further comprising:

writing the identifying information onto the planar surface by hand, or adhering printed information as the identifying information to the planer surface.

14. The method of claim 11, further comprising:

writing or printing identifying information onto an adhesive sticker; and securing the adhesive sticker onto the planar surface of the label panel.

15. The method of claim 14, wherein the identifying information comprises a bar code.

16. The method of claim 11, further comprising:

removing the label panel from the support panel.

17. The method of claim 16, wherein the server tag further comprises:

a pivoting connection between the label panel and the support panel.

18. The method of claim 17, wherein the pivoting connection comprises:

a frusto-circular member connected to the label panel;

a rod extending along an upper edge of the support panel;

and wherein the frusto-conical member is configured to releasably snap onto the rod.

19. An IT server tag assembly, comprising:

a plurality of adhesive stickers, wherein each sticker comprises a cellulosic layer designed to receive printed information; and a plurality of IT server tags, wherein each server tag comprises:

a base having a pair of slots for receiving respective equipment screws, wherein the equipment screws are connected to a network server panel;

a support panel extending up from the base; and a label panel pivotally connected to the support panel, wherein the label panel defines a generally planar surface adapted to receive the adhesive sticker;

a pivoting connection between the label panel and the support panel, wherein the support panel comprises:

a first end connected to the base; and a second end opposite the first end, with the second end forming an angled tip;

and wherein the angled tip terminates in the pivoting connection;

and wherein the plurality of adhesive stickers and the plurality of server tags are packaged together for commercial sale.

20. The IT server tag assembly of claim 19, further comprising:

a marker suitable for applying handwritten text onto a surface of each of the respective adhesive stickers.

* * * * *